US009262966B2

(12) United States Patent
Qi et al.

(10) Patent No.: US 9,262,966 B2
(45) Date of Patent: Feb. 16, 2016

(54) PIXEL CIRCUIT, DISPLAY PANEL AND DISPLAY APPARATUS

(71) Applicants: BOE TECHNOLOGY GROUP CO., LTD., Beijing (CN); CHENGDU BOE OPTOELECTRONICS TECHNOLOGY CO., LTD., Chengdu, Sichuan (CN)

(72) Inventors: Xiaojing Qi, Beijing (CN); Wen Tan, Beijing (CN)

(73) Assignees: BOE TECHNOLOGY GROUP CO., LTD., Beijing (CN); CHENGDU BOE OPTOELECTRONICS TECHNOLOGY CO., LTD., Chengdu, Sichuan (CN)

( * ) Notice: Subject to any disclaimer, the term of this patent is extended or adjusted under 35 U.S.C. 154(b) by 0 days.

(21) Appl. No.: 14/370,189

(22) PCT Filed: Nov. 21, 2013

(86) PCT No.: PCT/CN2013/087592

§ 371 (c)(1),
(2) Date: Jul. 1, 2014

(87) PCT Pub. No.: WO2015/000249

PCT Pub. Date: Jan. 8, 2015

(65) Prior Publication Data

US 2015/0206476 A1 Jul. 23, 2015

(30) Foreign Application Priority Data

Jul. 2, 2013 (CN) ..... 2013 1 0274848

(51) Int. Cl.
*G09G 3/32* (2006.01)

(52) U.S. Cl.
CPC ..... *G09G 3/3258* (2013.01); *G09G 3/3233* (2013.01); *G09G 2300/0439* (2013.01);
(Continued)

(58) Field of Classification Search
USPC ..... 345/76
See application file for complete search history.

(56) References Cited

U.S. PATENT DOCUMENTS 7,773,082 B2 * 8/2010 Miyagawa ..... G09G 3/3233 345/212
2005/0285827 A1 * 12/2005 Eom ..... 345/76
(Continued)

FOREIGN PATENT DOCUMENTS

CN 102956199 A 3/2013
CN 103000131 A 3/2013
(Continued)

OTHER PUBLICATIONS

Written Opinion of the International Searching Authority dated Feb. 4, 2014; PCT/CN2013/087592.
(Continued)

*Primary Examiner* — Grant Sitta
(74) *Attorney, Agent, or Firm* — Ladas & Parry LLP

(57) ABSTRACT

A pixel circuit, a display panel and a display apparatus are used to improve the lifetime of the light emitting devices in the display apparatus. The pixel circuit comprises: a charging sub-circuit (1), a first driving sub-circuit (2), a second driving sub-circuit (3), a first capacitor (C1) and a second capacitor (C2). A first terminal (A) of the first capacitor (C1) is connected to a first terminal of the first driving sub-circuit (2) and a first terminal of the second driving sub-circuit (3), and a second terminal (B) of the first capacitor (C1) is connected to the charging sub-circuit (1) and a first terminal (C) of the second capacitor; a second terminal of the first driving sub-circuit (2) is connected to a first light emitting device (D1), a second terminal of the second driving sub-circuit (3) is connected to a second light emitting device (D2), wherein the driving current flowing from the first driving sub-circuit (2) to the first light emitting device (D1) is in an opposite direction to the driving current flowing from the second driving sub-circuit (3) to the second light emitting device (D2).

17 Claims, 13 Drawing Sheets

(52) U.S. Cl.
CPC .... *G09G2300/08* (2013.01); *G09G 2300/0852* (2013.01); *G09G 2300/0861* (2013.01); *G09G 2310/0262* (2013.01); *G09G 2320/043* (2013.01)

(56) References Cited

U.S. PATENT DOCUMENTS

2006/0290623 A1* 12/2006 Okabe et al. ..... 345/82
2009/0096723 A1 4/2009 Kawabe
2009/0315874 A1* 12/2009 Kim ..... 345/213

FOREIGN PATENT DOCUMENTS

CN 103383834 A 11/2013
JP 2012-133165 A 7/2012

OTHER PUBLICATIONS

International Search Report dated Jan. 4, 2014; PCT/CN2013/087592.

* cited by examiner

PIXEL CIRCUIT, DISPLAY PANEL AND DISPLAY APPARATUS

TECHNICAL FIELD OF THE DISCLOSURE

The present disclosure relates to the technical field of organic light emitting display, and in particular, to a pixel circuit, a display panel and a display apparatus.

BACKGROUND

Organic light emitting display devices draw lots of attention due to their advantages such as low power consumption, high brightness, low cost, wide angle of view, fast response, and so on, and have been widely used in the technical field of organic light emitting.

The Organic Light Emitting Diode (OLED) is a kind of light emitting device that is currently used a lot in the field of organic light emitting. Currently, OLEDs can be classified into two categories which are passive driving OLEDs and active driving OLEDs, i.e. direct addressing OLEDs and Thin Film Transistor (TFT) matrix addressing OLEDs. The active driving OLED is also referred to an Active Matrix OLED (AMOLED). The light emitting device in each sub-pixel unit is driven by a pixel circuit and a power line applying a direct current (DC) power voltage signal ($V_{DD}$ or $V_{SS}$) to emit light.

Refer to FIG. 1 which is a schematic structural diagram of a pixel circuit for driving the light emitting device to emit light in the prior art, taking n type driving transistors as an example, the pixel circuit comprises a driving transistor T1, a capacitor C1 and a switch transistor T2.

A first terminal of the capacitor C1 is connected to the gate of the driving transistor T1, and a second terminal of the capacitor C1 is connected to a low level reference voltage source $V_{SS}$. The drain of the switch transistor T2 is connected to the gate of the driving transistor T1, the gate of the switch transistor T2 is connected to a gate signal source $V_{Scan}$, and the source of the switch transistor T2 is connected to a data signal source $V_{Data}$. The source of the driving transistor T1 is connected to a high level reference voltage source $V_{DD}$, the drain of the driving transistor T1 is connected to the anode of a light emitting device D1, and the cathode of the light emitting device D1 is connected to the low level reference voltage source $V_{SS}$.

At the stage of displaying one frame of picture, before the light emitting device D1 is driven to emit light, the gate signal source outputs a voltage signal $V_{Scan}$ to turn on the switch transistor T2, the data signal source is connected to the branch where the capacitor C1 is located, and the data signal source outputs a data signal $V_{Data}$ to be applied to the second terminal of the capacitor C1 to charge the capacitor C1. At the stage of driving the light emitting device D1 to emit light, the capacitor C1 discharges to drive the light emitting device D1 to emit light.

The pixel circuit shown in FIG. 1 can only drive one light emitting device to emit light, and each light emitting device is corresponding to the light emitting area of one pixel unit. When scanning each frame of picture, signals all need to be written into the pixel circuit. When scanning each frame of picture, the light emitting areas corresponding to the pixel units all need to emit light for displaying. The driving mode in which the AMOLED display drives the OLED to emit light is DC driving. The electric field corresponding to a long time DC driving voltage would polarize the ions inside the OLED to make the OLED form a built-in electric field, such as to increase the threshold voltage of the OLED, decrease the light-emitting efficiency of the OLED dramatically, and shorten the lifetime of the OLED. The lifetime is an important factor limiting the wide application of the organic light-emitting display, in particular, the large size and high brightness organic light emitting display apparatus.

SUMMARY

Embodiments of the present disclosure provide a pixel circuit, a display panel and a display apparatus to improve the lifetime of the light emitting devices in the display apparatus.

A pixel circuit according to an embodiment of the present disclosure comprises a charging sub-circuit, a first driving sub-circuit, a second driving sub-circuit, a first capacitor and a second capacitor, wherein a first terminal of the first capacitor is connected to a first terminal of the first driving sub-circuit and a first terminal of the second driving sub-circuit, and a second terminal of the first capacitor is connected to the charging sub-circuit and a first terminal of the second capacitor;

a second terminal of the first driving sub-circuit is connected to a first light emitting device, and a second terminal of the second driving sub-circuit is connected to a second light emitting device, wherein the flow direction of the driving current flowing into the first light emitting device from the first driving sub-circuit is opposite to that of the driving current flowing into the second light emitting device from the second driving sub-circuit; and the charging sub-circuit is used to charge the first capacitor, the second capacitor is used to maintain the voltage at a second terminal of the first capacitor, and when the first capacitor discharges, the first driving sub-circuit drives the first light emitting device to emit light or the second driving sub-circuit drives the second light emitting device to emit light.

Exemplarily, the first driving sub-circuit comprises an N-type driving transistor, and the second driving sub-circuit comprises a P-type driving transistor; wherein the gate of the N-type driving transistor is connected to the first terminal of the first capacitor, the source of the N-type driving transistor is connected to a first reference voltage source capable of providing an alternative current (AC) signal, the drain of the N-type driving transistor is connected to the cathode of the first light emitting device, the anode of the first light emitting device is connected to a second reference voltage source capable of providing an AC signal, and a second terminal of the second capacitor is connected to the first reference voltage source; and the gate of the P-type driving transistor is connected to the first terminal of the first capacitor, the source of P-type driving transistor is connected to the first reference voltage source, the drain of the P-type driving transistor is connected to the anode of the second light emitting device, and the cathode of the second light emitting device is connected to the second reference voltage source.

Exemplarily, the charging sub-circuit comprises a data signal source, a first gate signal source, and a first switch transistor connected to the data signal source and the first gate signal source;

the drain of the first switch transistor is connected to the data signal source, the source of the first switch transistor is connected to the second terminal of the first capacitor, and the gate of the first switch transistor is connected to the first gate signal source;

the first gate signal source is used to control the first switch transistor to turn on such that the branch where the data signal source and the first capacitor are located is connected, and the data signal source charges the first capacitor.

Exemplarily, the pixel circuit further comprises a reset sub-circuit comprising a second gate signal source, a second switch transistor and a third reference voltage source to be reset to a reference reset voltage, wherein the source of the second switch transistor is connected to the second terminal of the first capacitor, the drain of the second switch transistor is connected to the third reference voltage source to be reset to the reference reset voltage, and the gate of the second switch transistor is connected to the second gate signal source; and the reset sub-circuit is used to reset the signal stored in the first capacitor to the reference reset voltage before the charging sub-circuit charges the first capacitor.

Exemplarily, the pixel circuit further comprises a first compensation sub-circuit connected to the first driving sub-circuit and a second compensation sub-circuit connected to the second driving sub-circuit;

the first compensation sub-circuit comprises a third switch transistor;

the second compensation sub-circuit comprises a fourth switch transistor;

the source of the third switch transistor is connected to the gate of the N-type driving transistor, the drain of the third switch transistor is connected to the drain of the N-type driving transistor, and the gate of the third switch transistor is connected to the third gate signal source; and the source of the fourth switch transistor is connected to the gate of the P-type driving transistor, the drain of the fourth switch transistor is connected to the drain of the P-type driving transistor, and the gate of the fourth switch transistor is connected to the third gate signal source.

Exemplarily, the pixel circuit further comprises a fifth switch transistor for controlling the connection of the first light emitting device and the second light emitting device to the second reference voltage source, wherein the gate of the fifth switch transistor is connected to a charging control signal source, the source of the fifth switch transistor is connected to the anode of the first light emitting device and the cathode of the second light emitting device, the drain of the fifth switch transistor is connected to the second reference voltage source, and the charging control signal source is used to control the turning on and off of the fifth switch transistor.

Exemplarily, the first switch transistor, the second switch transistor, the third switch transistor, the fourth switch transistor and the fifth switch transistor are N-type transistors, or the first switch transistor, the second switch transistor, the third switch transistor, the fourth switch transistor and the fifth switch transistor are P-type transistors;

the second gate signal source and the third gate signal source are the same gate signal source.

According to an embodiment of the present disclosure, there is provided a display panel comprising multiple pixel units arranged in matrix surrounded by gate lines and data lines, each pixel unit comprising one pixel circuit and light emitting devices connected to the pixel circuit, wherein the pixel circuit is a pixel circuit described in the above;

the charging sub-circuits in the pixel circuits located in the same row are connected to the same gate line, the charging sub-circuits in the pixel circuits located in the same column are connected to the same data line; at the stage of displaying one frame of picture, before the first driving sub-circuit and the second driving sub-circuit drive the first light emitting device to emit light and the second light emitting device to emit light respectively in sequence, the charging sub-circuits charge the first capacitor through the data line and the gate line.

Exemplarily, the pixel circuit is a pixel circuit described in the above.

The drain of the first switch transistor is connected to the data signal source through the data line, the gate of the first switch transistor is connected to the first gate signal source through the gate line; and the gate signal source and the data signal source charge the first capacitor through the gate line and the data line respectively.

According to an embodiment of the present disclosure, there is provided a display apparatus comprising a display panel described in the above.

According to the present disclosure, a first light emitting device and a second light emitting device connected in parallel are arranged in each pixel area, the operating current of the first light emitting device is in the opposite direction to that of the second light emitting device, and the first light emitting device and the second light emitting device are driven to emit light by a N-type driving transistor and a P-type driving transistor respectively. The first light emitting device and the second light emitting device emit light alternately, such that the lifetime of each light emitting device can be improved.

DETAILED DESCRIPTION

Embodiments of the present disclosure provide a pixel circuit, a display panel and a display apparatus to improve the lifetime of the light emitting devices in the display apparatus and ease the problem of the light-emitting display nonuniformity of light emitting devices.

It is noted that there is no substantial difference between the source and the drain for a transistor in the display field. Therefore, the source of a transistor mentioned in embodiments of the present disclosure can be the drain of the transistor, and the drain of the transistor can be the source of the transistor.

An AMOLED display panel comprises multiple pixel units arranged in matrix surrounded by gate lines and data lines, wherein each pixel unit comprises one pixel circuit. In embodiments of the present disclosure, a first driving sub-circuit and a second driving sub-circuit connected in parallel are arranged in each pixel circuit, and the two driving sub-circuits drive a first light emitting device and a second light emitting device respectively connected thereto to emit light in turn during different periods respectively. For example, during display time t of one frame of picture, the first light emitting device is driven by the first driving sub-circuit to emit light during the time of former (½)t, and the second light emitting device is driven by the second driving sub-circuit to emit light during the time of latter (½)t. Compared with the pixel circuit in which one light emitting device is arranged in one pixel unit, the lifetime of the light emitting devices provided by embodiments of the present disclosure can be at least doubled.

In general, the procedure of the pixel circuit driving the light emitting device to emit light includes at least two stages, i.e., a data signal writing stage and a light emitting stage. Before the first driving sub-circuit and the second driving sub-circuit drive the first light emitting device and the second light emitting device to emit light respectively, the charging sub-circuit is configured to charge the capacitor in the driving sub-circuit. The capacitor discharges in the light emitting stage after being charged to drive the light emitting device in the first driving sub-circuit or the second driving sub-circuit to emit light.

In the following, the pixel circuit, the display panel and the display apparatus provided by embodiments of the present disclosure will be described in detail in connection with the accompanying drawings.

Figure 1:
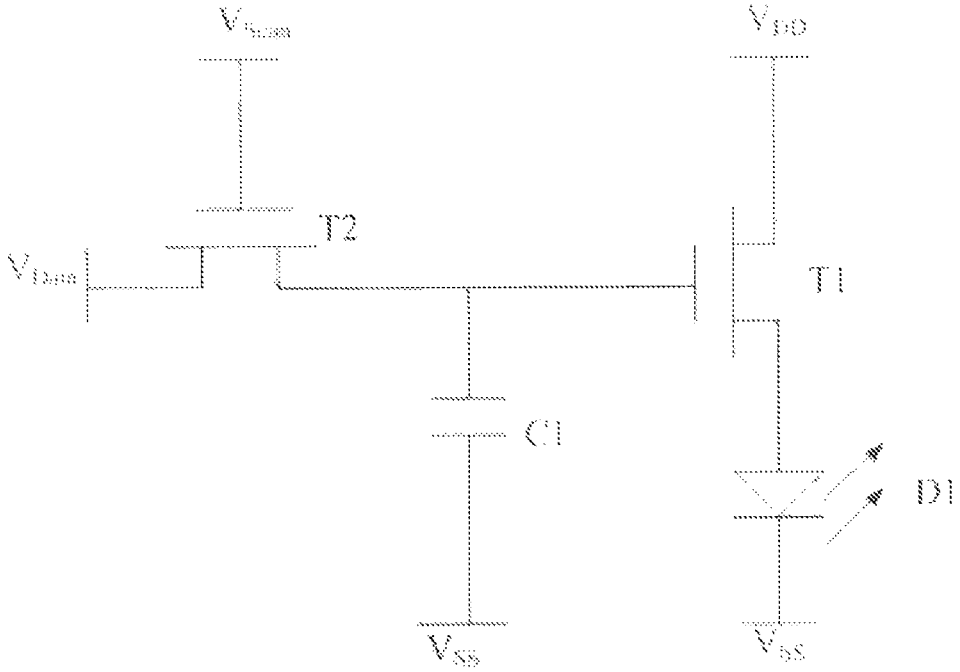
Fig.1 (PRIOR ART)
FIG. 1 is a structural schematic diagram of a pixel circuit in the prior art.
Figure 2:
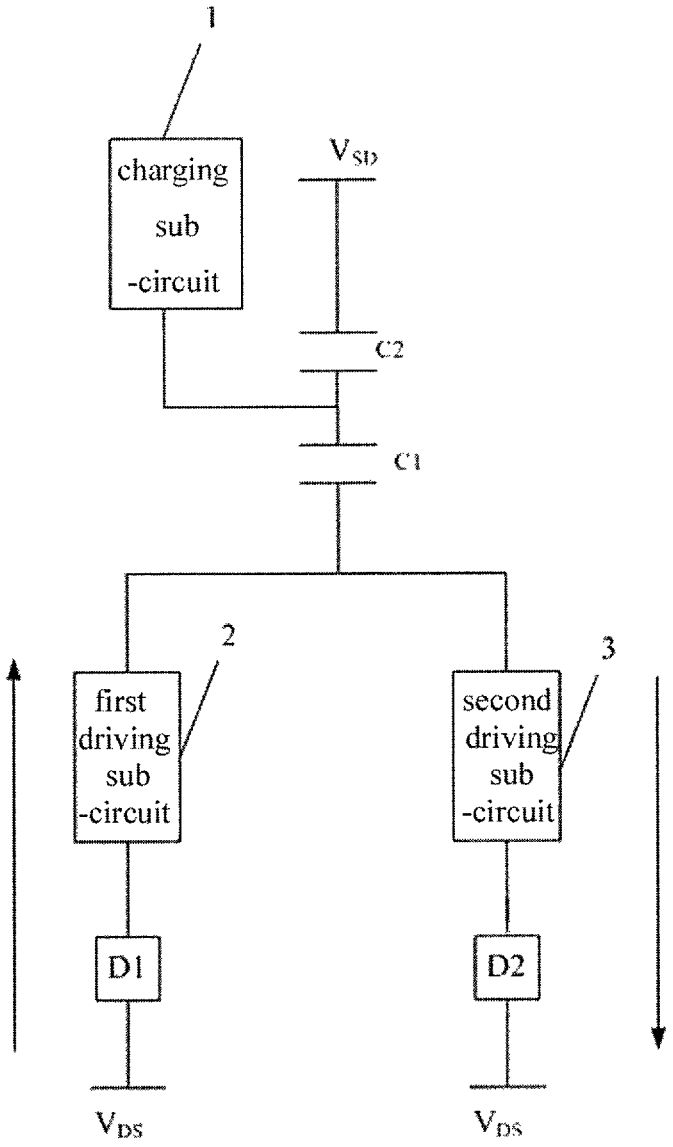
FIG. 2 is a first structural schematic diagram of a pixel circuit of an embodiment of the present disclosure.

Referring to FIG. 2, the pixel circuit according to an embodiment of the present disclosure comprises a charging sub-circuit 1, a first capacitor C1, a second capacitor C2, a first driving sub-circuit 2 and a second driving sub-circuit 3.

A first terminal of the first capacitor C1 is connected to a first terminal of the first driving sub-circuit 2 and a first terminal of the second driving sub-circuit 3, and a second terminal of the first capacitor C1 is connected to the charging sub-circuit 1 and a first terminal of the second capacitor C2.

A second terminal of the first driving sub-circuit 2 is connected to a first light emitting device D1, and a second terminal of the second driving sub-circuit 3 is connected to a second light emitting device D2, wherein the flow direction of the driving current flowing into the first light emitting device D1 from the first driving sub-circuit 2 is opposite to that of the driving current flowing into the second light emitting device D2 from the second driving sub-circuit 3. The line segments with arrows in FIG. 2 represent the directions of the driving currents.

The charging sub-circuit 1 is used to charge the first capacitor C1, the second capacitor C2 is used to maintain the voltage at a second terminal of the first capacitor C1, and when the first capacitor C1 discharges, the first driving sub-circuit 2 drives the first light emitting device D1 to emit light or the second driving sub-circuit 3 drives the second light emitting device D2 to emit light.

Exemplarily, the light emitting devices such as the first light emitting device and the second light emitting device in the embodiment of the present disclosure can be OLEDs or other organic electroluminescent elements, which are not limited in the present disclosure.

It should be noted that although the first driving sub-circuit and the second driving sub-circuit as shown in FIG. 2 shares the first capacitor C1, the first driving sub-circuit and the second driving sub-circuit in an embodiment of the present disclosure can also be connected one capacitor respectively, and the two capacitors are connected in parallel.

Next, the pixel circuit provided by FIG. 2 will be described in more detail by examples.

Figure 3:
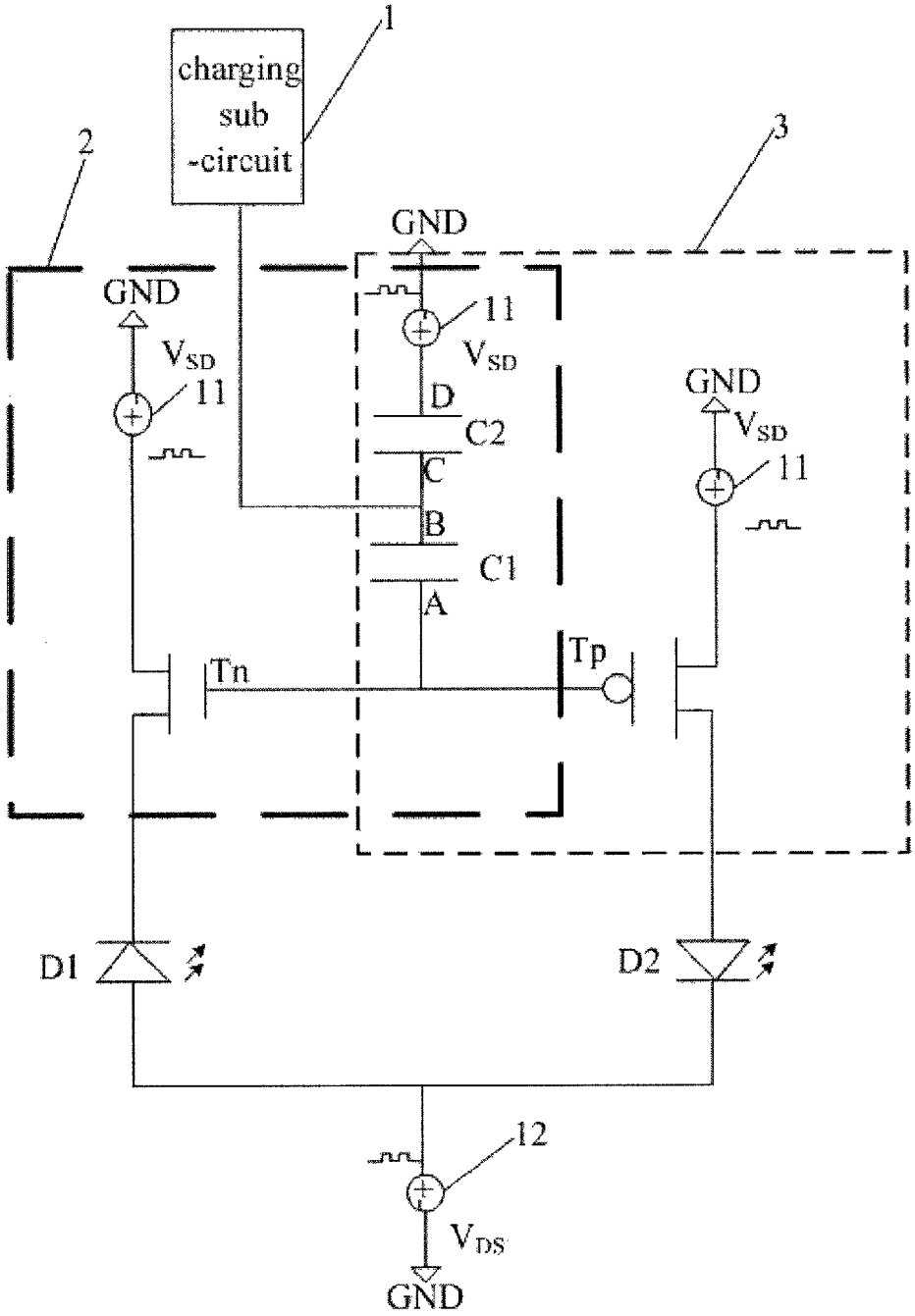
FIG. 3 is a second structural schematic diagram of a pixel circuit of an embodiment of the present disclosure.

Referring to FIG. 3, a pixel circuit according to an embodiment of the present disclosure comprises the charging sub-circuit 1, the first capacitor C1, the second capacitor C2, the first driving sub-circuit 2 and the second driving sub-circuit 3. The first driving sub-circuit 2 is connected to the first light emitting device D1, and the second driving sub-circuit 3 is connected to the second light emitting device D2.

The first driving sub-circuit 2 comprises an N-type driving transistor Tn, wherein the gate of the N-type driving transistor Tn is connected to the first terminal (terminal A) of the first capacitor C1, the source of the N-type driving transistor Tn is connected to the output terminal of a first reference voltage source 11 capable of providing an alternative current (AC) voltage signal, the drain of the N-type driving transistor Tn is connected to the cathode of the first light emitting device D1, a second terminal (terminal B) of the first capacitor C1 is connected to a first terminal (terminal C) of the second capacitor C2, a second terminal (terminal D) of the second capacitor C2 is connected to the output terminal of the first reference voltage source 11 (that is, the first capacitor C1 is connected to the second capacitor C2 in series), and the anode of the first light emitting device D1 is connected to the output terminal of a second reference voltage source 12 capable of providing an AC voltage signal.

The second driving sub-circuit 3 comprises a P-type driving transistor Tp, wherein the gate of the P-type driving transistor Tp is connected to the first terminal (terminal A) of the first capacitor, the source of P-type driving transistor Tp is connected to the output terminal of the first reference voltage source 11, the drain of the P-type driving transistor Tp is connected to the anode of the second light emitting device D2, the second terminal (terminal B) of the first capacitor C1 is connected to the first terminal (terminal C) of the second capacitor C2, the second terminal (terminal D) of the second capacitor C2 is connected to the output terminal of the first reference voltage source 11, and the cathode of the second light emitting device D2 is connected to the output terminal of the second reference voltage source 12.

The charging sub-circuit 1 is connected to the second terminal (terminal B) of the first capacitor C1.

The charging sub-circuit 1 is used to input a data signal to the first capacitor C1 before the first light emitting device D1 or the second light emitting device D2 is driven to emit light, and the second capacitor is used to maintain the potential at the second terminal (terminal B) of the first capacitor C1.

The first driving sub-circuit 2 and the second driving sub-circuit 3 are used to drive the first light emitting device D1 and the second light emitting device D2 to emit light respectively under the control of time sequence signals.

According to the pixel circuit of the embodiment of the present disclosure, the first light emitting device and the second light emitting device emit light alternately, and thus respective lifetimes are at least doubled.

Further, according to the pixel circuit of the embodiment of the present disclosure, the first driving sub-circuit and the second driving sub-circuit share the first capacitor and the second capacitor, and share the first reference voltage source and the second reference voltage source. Since the first driving sub-circuit and the second driving sub-circuit operate in different periods, the first capacitor, the second capacitor, the first reference voltage source and the second reference voltage source operate in a manner of time division, which can simplify the circuit structure.

Upon implementation, according to the pixel circuit of the embodiment of the present disclosure, the alternate operation of the first driving sub-circuit and the second driving sub-circuit can be realized by switching the high and low level states of the output voltage of the first reference voltage source and the second reference voltage source. In particular, when the first reference voltage source and the second reference voltage source output a high level voltage and a low level voltage respectively, the second driving sub-circuit drives the second light emitting device to emit light; when the first reference voltage source and the second reference voltage source output a low level voltage and a high level voltage respectively, the first driving sub-circuit drives the first light emitting device to emit light.

It is noted that according to the pixel circuit of the embodiment of the present disclosure, the number of the light emitting devices connected to the first driving sub-circuit is not limited to one, and the number of the light emitting devices connected to the second driving sub-circuit is not limited to one either. The first driving sub-circuit and the second driving sub-circuit can be respectively connected to multiple light emitting devices mutually connected in series, which is not limited here.

It is assumed that the high level voltage of the voltage $V_{SD}$ output by the first reference voltage source is $V_{DD}$ and low level voltage thereof is $V_{SS}$; the high level voltage of the voltage $V_{DS}$ output by the second reference voltage source is $V_{DD}$ and low level voltage thereof is $V_{SS}$. $V_{DD}$ is a positive value larger than zero, and the value of $V_{SS}$ can be zero or a negative value smaller than zero.

The pixel circuit structure shown in FIG. 3 will be described by example in the following.

Figure 4:
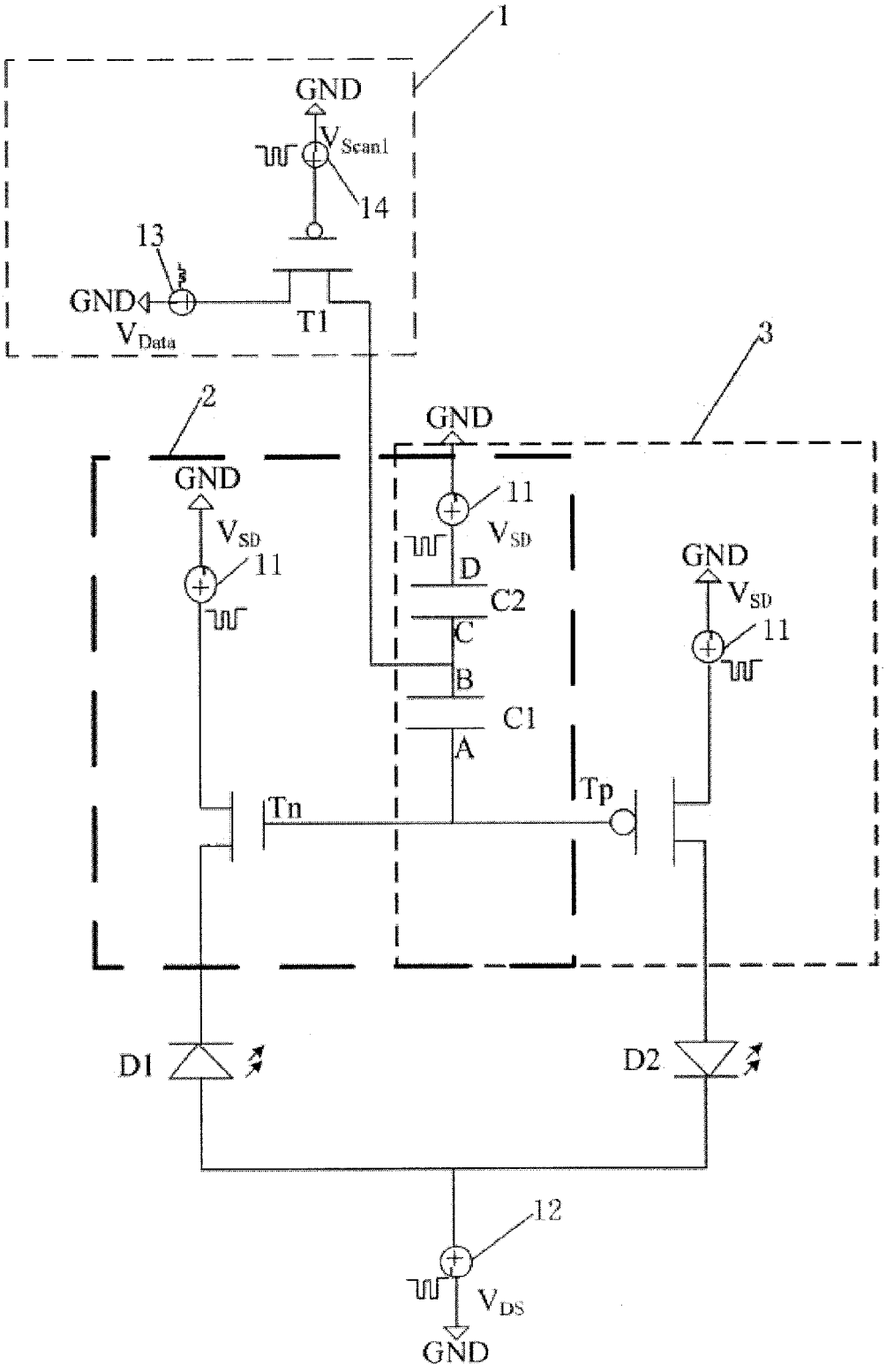
FIG. 4 is a third structural schematic diagram of a pixel circuit of an embodiment of the present disclosure.

Referring to FIG. 4, the charging sub-circuit 1 shown in FIG. 3 can comprise a data signal source 13, a first gate signal source 14, and a first switch transistor T1 connected to the data signal source 13 and the first gate signal source 14.

In particular, the drain of the first switch transistor T1 is connected to the output terminal of the data signal source 13, the source of the first switch transistor T1 is connected to the second terminal (terminal B) of the first capacitor C1, and the gate of the first switch transistor T1 is connected to the output terminal of the first gate signal source 14. The first gate signal source 14 is used to turn on and off the first switch transistor T1 under the control of the timing signal, and the data signal source 13 is used to write a data signal to the first capacitor C1 when the first switch transistor T1 is turned on.

It is noted that the first switch transistor T1 functions as a switch, which can be a N-type transistor or a P-type transistor. The first switch transistor T1 shown in FIG. 4 is a P-type transistor.

Figure 5:
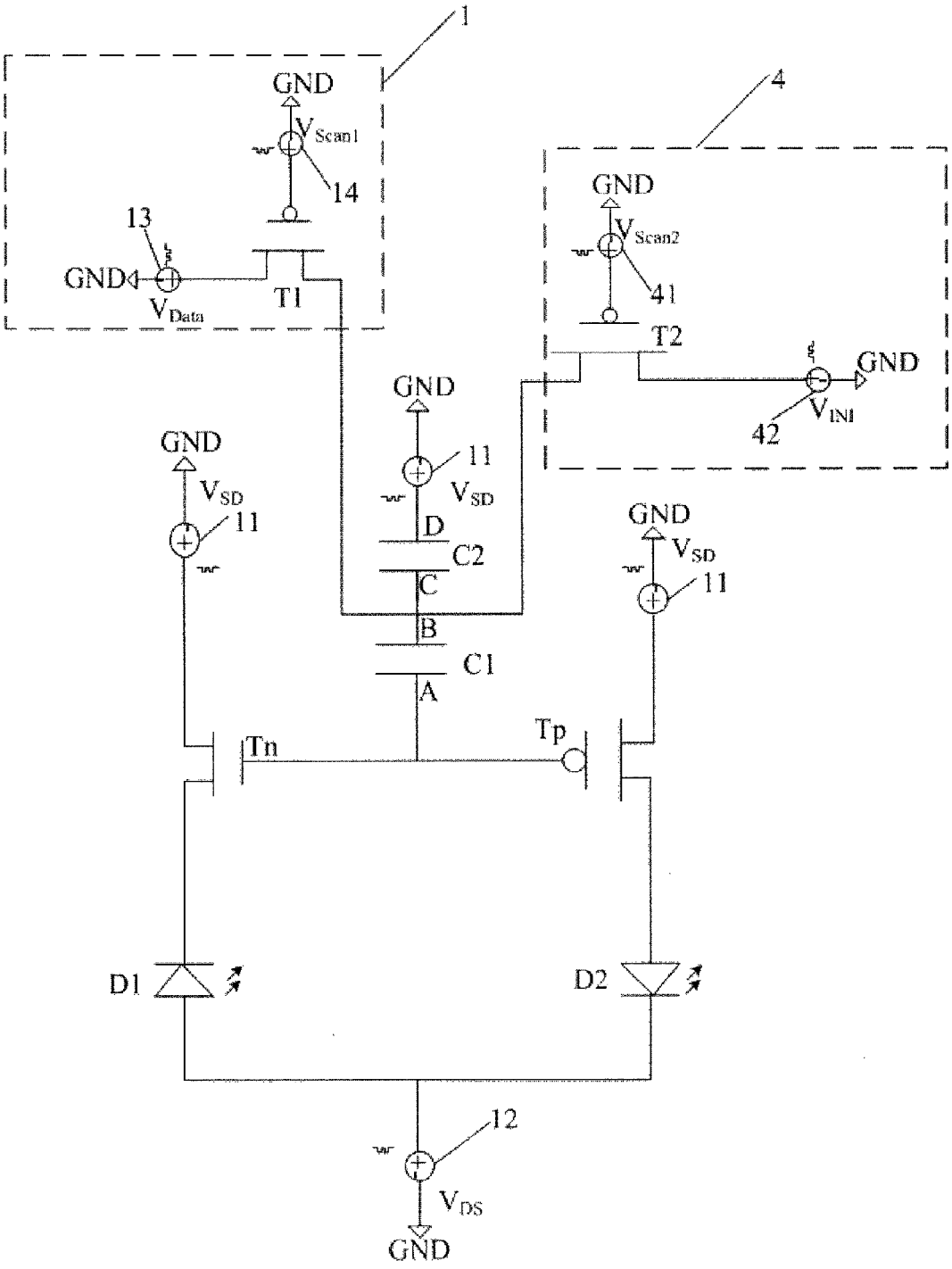
FIG. 5 is a fourth structural schematic diagram of a pixel circuit of an embodiment of the present disclosure.

Referring to FIG. 5, in order to ensure the previous frame of signal influences the next frame of signal the least, the pixel circuit according to the embodiment of the present disclosure can further comprise a reset sub-circuit 4 for resetting the voltage at the second terminal (terminal B) of the first capacitor C1 to a reference reset voltage $V_{IN1}$ before the charging sub-circuit 1 charges.

The reset sub-circuit 4 comprises a second gate signal source 41, a second switch transistor T2 and a third reference voltage source 42 for supplying the reference reset voltage $V_{IN1}$.

The source of the second switch transistor T2 is connected to the second terminal B of the first capacitor C1, the drain of the second switch transistor T2 is connected to the third reference voltage source 42 supplying the reference reset voltage, and the gate of the second switch transistor T2 is connected to the output terminal of the second gate signal source 41.

The voltage output by the third reference voltage source 42 can be a constant voltage with a certain value, which can be $V_{IN1}$ or a grounded voltage GND.

In an embodiment of the present disclosure, in order to realize that the driving current is irrelevant with the threshold voltage $V_{th1}$ of the N-type driving transistor Tn or the threshold voltage $V_{th2}$ of the P-type driving transistor Tp to avoid the light-emitting nonuniformity problem of respective pixels caused by the threshold voltage difference between different driving transistors, the pixel circuit also comprises a compensation sub-circuit to solve the above problems.

Figure 6:
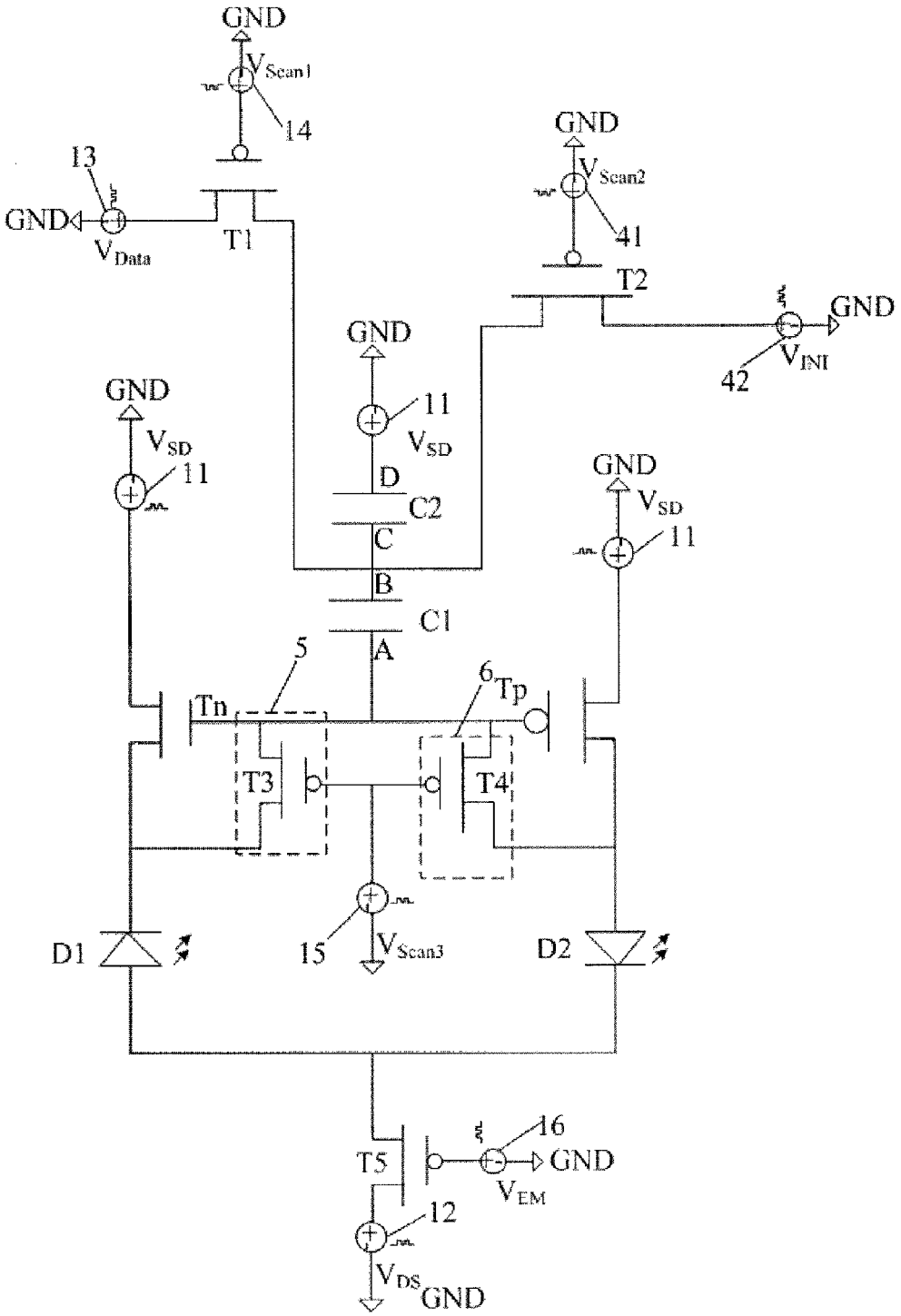
FIG. 6 is a fifth structural schematic diagram of a pixel circuit of an embodiment of the present disclosure.

Referring to FIG. 6, the pixel circuit according to an embodiment of the present disclosure further comprises a first compensation sub-circuit 5 connected to the first driving sub-circuit 2 and a second compensation sub-circuit 6 connected to the second driving sub-circuit 3.

The first compensation sub-circuit 5 comprises a third switch transistor T3. The source of the third switch transistor T3 is connected to the gate of the N-type driving transistor Tn, the drain of the third switch transistor T3 is connected to the drain of the N-type driving transistor Tn, and the gate of the third switch transistor T3 is connected to the output terminal of the third gate signal source 15.

The second compensation sub-circuit 6 comprises a fourth switch transistor T4. The source of the fourth switch transistor T4 is connected to the gate of the P-type driving transistor Tp, the drain of the fourth switch transistor T4 is connected to the drain of the P-type driving transistor Tp, and the gate of the fourth switch transistor T4 is connected to the output terminal of the third gate signal source 15.

Exemplarily, the first light emitting device and the second light emitting device according to an embodiment of the present disclosure can be OLED or any other organic electroluminescent element, which is not limited here.

Figure 7:
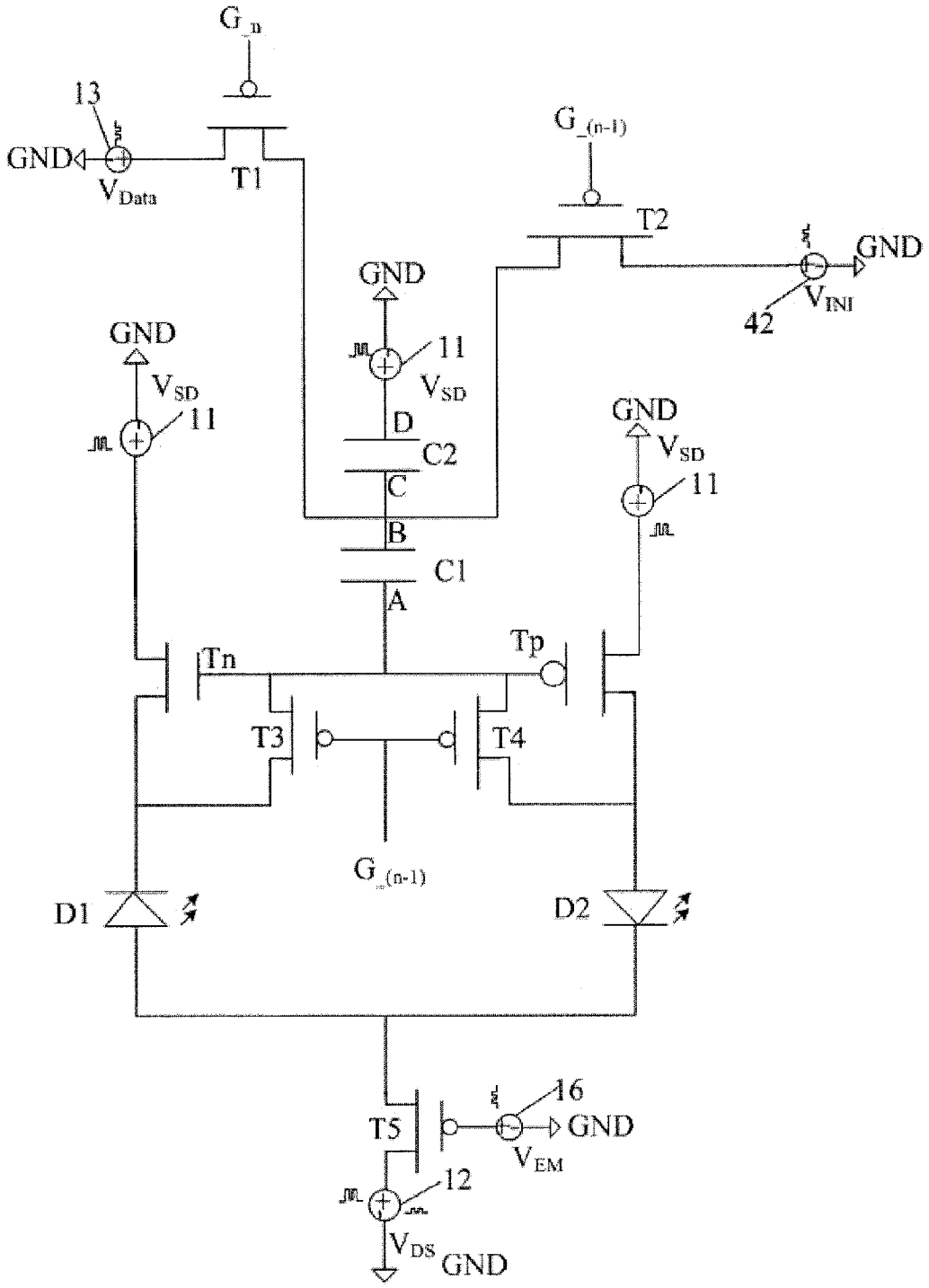
FIG. 7 is a sixth structural schematic diagram of a pixel circuit of an embodiment of the present disclosure.

Referring to FIG. 7, in order to avoid the influence of the second reference voltage source 12 of the pixel circuit on the charging sub-circuit 1 at the writing stage, the pixel circuit further comprises a fifth switch transistor T5.

The gate of the fifth switch transistor T5 is connected to the output terminal of a charging control signal source 16, the source of the fifth switch transistor T5 is connected to both the anode of the first light emitting device D1 and the cathode of the second light emitting device D2, and the drain of the fifth switch transistor T5 is connected to the output terminal of the second reference voltage source 12. The charging control signal source 16 controls the turning on or off of the fifth switch transistor T5 under the control of the time sequence.

Exemplarily, the first switch transistor, the second switch transistor, the third switch transistor, the fourth switch transistor and the fifth switch transistor can all be the same in type or can partly be the same in type. For example, the first switch transistor, the second switch transistor, the third switch transistor, the fourth switch transistor and the fifth switch transistor are all N-type transistors or P-type transistors.

When the first switch transistor, the second switch transistor, the third switch transistor, the fourth switch transistor and the fifth switch transistor are all the same in type, the second gate signal source and the third gate signal source are the same gate signal source, i.e., share the same gate signal source, such as to achieve the object of simplifying the circuit structure.

In the specific implementation procedure, the first gate signal source, the second gate signal source and the third gate signal source are connected to respective switch transistors through gate lines. The data signal source is connected to the first switch transistor through a data line.

As shown in FIG. 7, the first gate signal source is connected to the first switch transistor T1 through the gate line G_n, and the first gate signal source supplies a gate voltage to the first switch transistor T1 (the first gate signal source is not shown in FIG. 7).

The second gate signal source is connected to the second switch transistor T2 through a gate line G_(n−1), the third gate signal source is connected to the third switch transistor T3 and the fourth switch transistor T4 respectively through the gate line G_(n−1) (the second gate signal source and the third gate signal source are not shown in FIG. 7).

The operation principle of the pixel circuit of an embodiment of the present disclosure will be described in detail next.

During the former ½ display time of one frame of picture, the first driving sub-circuit is controlled to drive the first light emitting device to emit light, and during the latter ½ display time, the second driving sub-circuit of the pixel circuit is controlled to drive the second light emitting device to emit light.

The procedure of controlling the first driving sub-circuit to drive the first light emitting device to emit light comprises the following stages specifically.

In a reset stage, the second gate signal source controls the second switch transistor to be turned on, the third gate signal source controls the third switch transistor and the fourth switch transistor to be turned on, the charging control signal source controls the fifth switch transistor to be turned on, and the first gate signal source controls the first switch transistor to be turned off. The first reference voltage source outputs a low level, and the second reference voltage source outputs a high level, such that the branch where the N-type driving transistor, the first capacitor and the second capacitor are located is connected, the voltage $V_{IN1}$ output by the third reference voltage source is applied to the second terminal of the first capacitor, and the second terminal of the second capacitor is reset to $V_{IN1}$.

In a writing stage, the first gate signal source controls the first switch transistor to be turned on, the second gate signal source controls the second switch transistor to be turned off, the third gate signal source controls the third switch transistor and the fourth switch transistor to be turned off, and the charging control signal source controls the fifth switch transistor to be turned off. The first reference voltage source outputs a low level, and the second reference voltage source outputs a high level, such that the branch where the N-type driving transistor, the first capacitor, the second capacitor and the data signal source are located is connected, the voltage output by the data signal source is applied to the second terminal of the first capacitor, and the first capacitor stores the data signal.

In a light emitting stage, the first gate signal source controls the first switch transistor to be turned off, the second gate signal source controls the second switch transistor to be turned off, the third gate signal source controls the third switch transistor and the fourth switch transistor to be turned off, and the charging control signal source controls the fifth switch transistor to be turned on. The first reference voltage source outputs a low level, and the second reference voltage source outputs a high level, such that the branch where the N-type driving transistor, the first capacitor, the second capacitor and the first light emitting device are located is connected, the first capacitor discharges, the first driving sub-circuit drives the first light emitting device to emit light.

The procedure of controlling the second driving sub-circuit to drive the second light emitting device to emit light comprises the following stages specifically.

In a reset stage, the second gate signal source controls the second switch transistor to be turned on, the third gate signal source controls the third switch transistor and the fourth switch transistor to be turned on, the charging control signal source controls the fifth switch transistor to be turned on, and the first gate signal source controls the first switch transistor to be turned off. The first reference voltage source outputs a high level, and the second reference voltage source outputs a low level, such that the branch where the N-type driving transistor, the first capacitor and the second capacitor are located is connected, the voltage $V_{IN1}$ output by the third reference voltage source is applied to the second terminal of the first capacitor, and the second terminal of the second capacitor is reset to $V_{IN1}$.

In a writing stage, the first gate signal source controls the first switch transistor to be turned on, the second gate signal source controls the second switch transistor to be turned off, the third gate signal source controls the third switch transistor and the fourth switch transistor to be turned off, and the charging control signal source controls the fifth switch transistor to be turned off. The first reference voltage source outputs a high level, and the second reference voltage source outputs a low level, such that the branch where the N-type driving transistor, the first capacitor, the second capacitor and the data signal source are located is connected, the voltage output by the data signal source is applied to the second terminal of the first capacitor, and the first capacitor stores the data signal.

In a light emitting stage, the first gate signal source controls the first switch transistor to be turned off, the second gate signal source controls the second switch transistor to be turned off, the third gate signal source controls the third switch transistor and the fourth switch transistor to be turned off, and the charging control signal source controls the fifth switch transistor to be turned on. The first reference voltage source outputs a high level, and the second reference voltage source outputs a low level, such that the branch where the N-type driving transistor, the first capacitor, the second capacitor and the first light emitting device are located is connected, the first capacitor discharges, the first driving sub-circuit drives the first light emitting to emit light.

In the following, the operation principles of the pixel circuit according to an embodiment of the present disclosure are described in detail in connection with the pixel circuit shown in FIG. 6 and the time sequence diagram of the operation procedure of the pixel circuit shown in FIG. 8.

It is assumed that the voltage signal output by the first gate signal source 14 is $V_{Scan1}$, the voltage signal output by the second gate signal source 41 is $V_{Scan2}$, and the voltage signal output by the third gate signal source 15 is $V_{Scan3}$.

The second gate signal source 41 and the third gate signal source 15 have the same time sequence diagram. Exemplarily, the second gate signal source 41 and the third gate signal source 15 are the same gate signal source. It is assumed that the voltage signal output by the charging control signal source 16 is $V_{EM}$, $V_{DD}$ is a positive value higher than GND, and $V_{SS}$ is a negative value lower than GND.

The description will be made by taking as an example that the first switch transistor T1, the second switch transistor T2, the third switch transistor T3, the fourth switch transistor T4 and the fifth switch transistor T5 are P-type transistors.

The N-type transistor is turned on when its gate is input with a high level voltage, and turned off when its gate is input with a low level voltage. The P-type transistor is turned on when its gate is input with a low level voltage, and turned off when its gate is input with a high level voltage.

Figure 8:
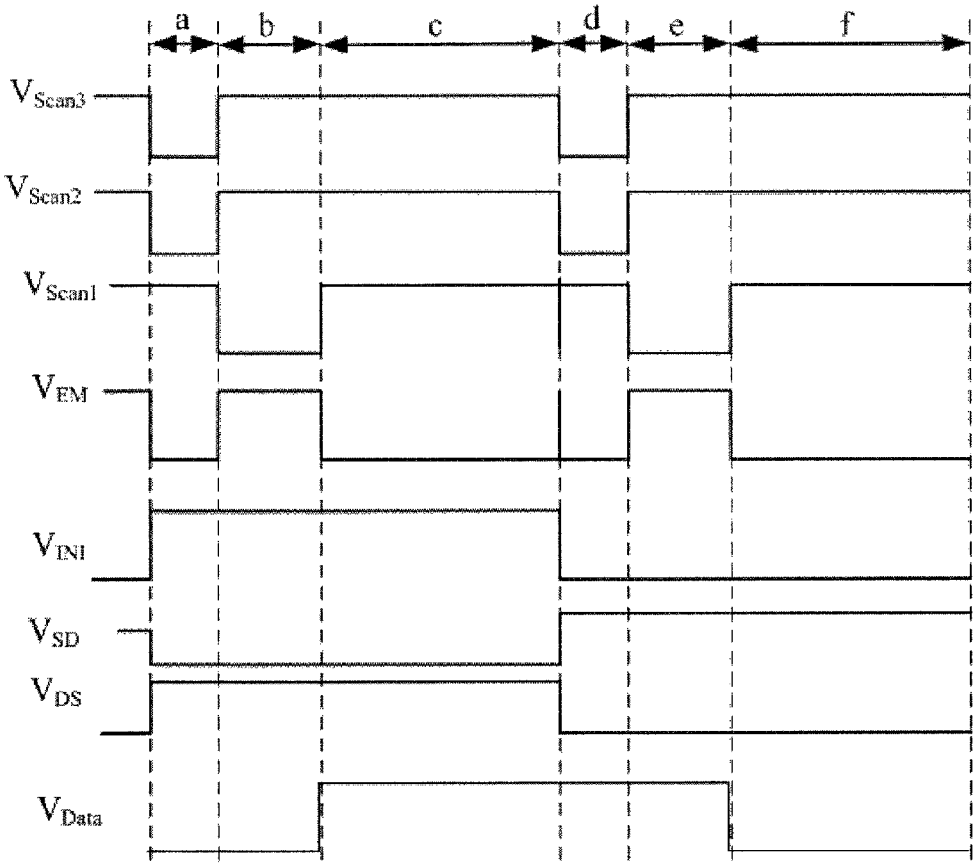
FIG. 8 is a time sequence diagram of the operation of the pixel circuit shown in FIG. 6.

In FIG. 6, the driving of the first light emitting device D1 to emit light is corresponding to the reset stage (stage a), the writing stage (stage b) and the light emitting stage (stage c) in FIG. 8; the driving of the second light emitting device D2 to emit light is corresponding to the reset stage (stage d), the writing stage (stage e) and the light emitting stage (stage f) in FIG. 8.

Stage a: Reset Stage

As shown in FIG. 8, the voltage $V_{Scan1}$ output by the first gate signal source 14 in FIG. 6 is a high level, and the first switch transistor T1 connected to the first gate signal source 14 is turned off.

The voltages $V_{Scan2}$ and $V_{Scan3}$ output by the second gate signal source 41 and the third gate signal source 15 are all low levels, and the second switch transistor T2, the third switch transistor T3 and the fourth switch transistor T4 connected to the second gate signal source 41 and the third gate signal source 15 respectively are turned on. The third switch transistor T3 is turned on such that the source and the drain of the N-type driving transistor Tn connected to the third switch transistor T3 are connected. At this time, the N-type driving transistor Tn is equivalent to a diode connection manner.

The voltage $V_{EM}$ output by the charging control signal source 16 is a low level, and the fifth switch transistor T5 connected to the charging control signal source 16 is turned on.

The first reference voltage source 11 outputs the low level voltage $V_{SS}$, and the second reference voltage source 12 outputs the high level voltage $V_{DD}$. The P-type driving transistor Tp is turned off, and the branch where the P-type driving transistor is located is disconnected. The N-type driving transistor Tn is turned on and the branch where the N-type driving transistor Tn is located is connected.

The third reference voltage source 42 output the reference reset voltage $V_{IN1}$.

Figure 9:
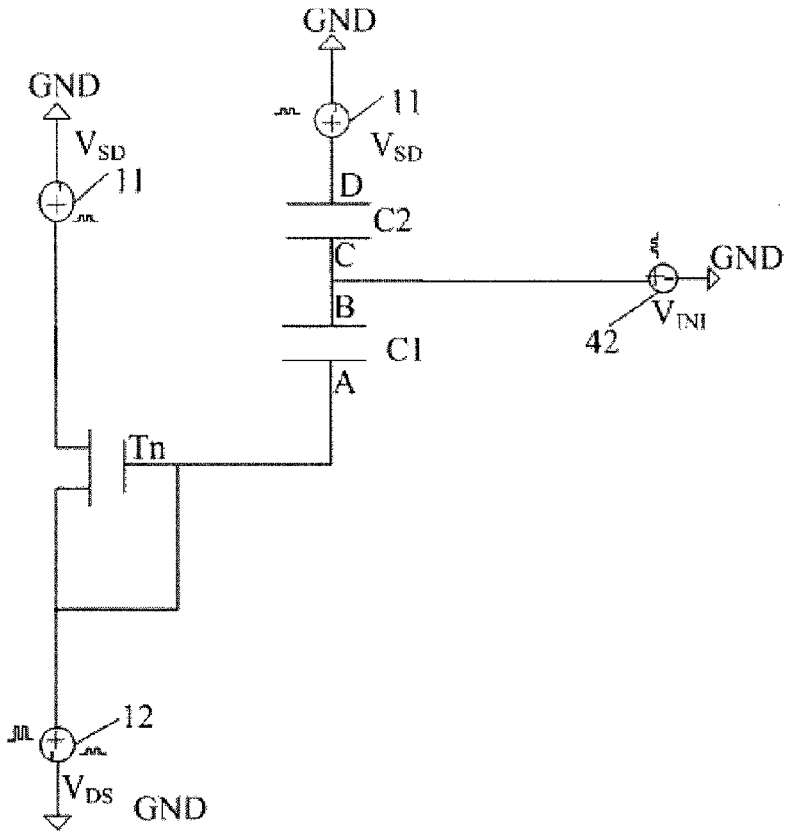
FIG. 9 is a structural schematic diagram of a pixel circuit with reset function corresponding to the first driving sub-circuit according to an embodiment of the present disclosure.

At this time, the pixel circuit shown in FIG. 6 is equivalent to the circuit structure shown in FIG. 9.

The branch where the N-type driving transistor Tn, the first capacitor C1, the third reference voltage source 42, the first reference voltage source 11 and the second reference voltage source 12 are located is connected.

The reference reset voltage $V_{IN1}$ output by the third reference voltage source 42 is applied to the second terminal (terminal B) of the first capacitor C1 and the first terminal (terminal C) of the second capacitor C2, i.e., $V_B=V_C=V_{IN1}$.

The gate of the N-type driving transistor Tn is discharged to $V_{th1}$, i.e., the gate voltage $V_g=V_{th1}$, where $V_{th1}$ is the threshold voltage of the N-type driving transistor Tn. The gate of the N-type driving transistor Tn is connected to the first terminal A of the first capacitor C1. The voltage of the first terminal A of the first capacitor C1 is thus equal to the gate voltage of the N-type driving transistor Tn, i.e., $V_A=V_g$.

At this time, the voltage between the two terminals of the first capacitor C1 is $V_A-V_B=V_g-V_B=V_{th1}-V_{IN1}$, where $V_A$ is the voltage at point A, $V_B$ is the voltage at point B, and $V_C$ is the voltage at point C.

Stage b: Writing Stage

As shown in FIG. 8, the voltage $V_{Scan1}$ output by the first gate signal source 14 in FIG. 6 is a low level, and the first switch transistor T1 connected to the first gate signal source 14 is turned on.

The voltages $V_{Scan2}$ and $V_{Scan3}$ output by the second signal source 41 and the third gate signal source 15 are all high levels, and the second switch transistor T2, the third switch transistor T3 and the fourth switch transistor T4 connected to the second gate signal source 41 and the third gate signal source 15 respectively are turned off.

The voltage $V_{EM}$ output by the charging control signal source 16 is a high level, and the fifth switch transistor T5 connected to the charging control signal source 16 is turned off.

The first reference voltage source 11 outputs the low level voltage $V_{SS}$, and the second reference voltage source 12 outputs the high level voltage $V_{DD}$. The P-type driving transistor Tp is turned off, and the branch where the P-type driving transistor is located is disconnected. The N-type driving transistor Tn is turned on and the branch where the N-type driving transistor Tn is located is connected.

Figure 10:
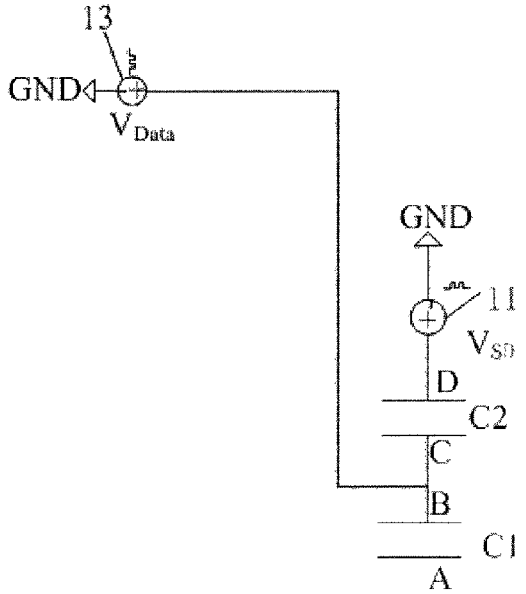
FIG. 10 is a structural schematic diagram of a pixel circuit with charging function corresponding to the first driving sub-circuit according to an embodiment of the present disclosure.

At this time, the pixel circuit shown in FIG. 6 is equivalent to the circuit structure shown in FIG. 10.

The branch where the first capacitor C1, the second capacitor C2, the data signal source 13, the N-type driving transistor Tn and the first reference voltage source 11 are located is connected.

The data signal source 13 outputs the data signal $V_{Data}$ which is applied to the second terminal (terminal B) of the first capacitor C1. According to the principle of charge conservation, the voltage $V_{Data}$ is also applied to the first terminal (terminal A) of the first capacitor C1. The voltage at the first terminal (terminal A) of the first capacitor C1 is the sum of the stored voltage $V_{th1}-V_{IN1}$ and the data signal $V_{Data}$, i.e., $V_A=V_{Data}+V_{th1}-V_{IN1}$.

At this time, the data signal is written into the first capacitor C1.

Stage c: Light Emitting Stage

As shown in FIG. 8, the voltage $V_{Scan1}$ output by the first gate signal source 14 in FIG. 6 is a high level, and the first switch transistor T1 connected to the first gate signal source 14 is turned off.

The voltage $V_{Scan2}$ output by the second gate signal source 41 is a high level, and the second switch transistor T2 connected to the second gate signal source 41 is turned off.

The voltage $V_{Scan3}$ output by the third gate signal source 15 is a high level, and the third switch transistor T3 and the fourth switch transistor T4 connected to the third gate signal source 15 are turned off. The connection manner of the N-type driving transistor Tn is a triode connection manner.

The voltage $V_{EM}$ output by the charging control signal source 16 is a low level, and the fifth switch transistor T5 connected to the charging control signal source 16 is turned on.

The output voltage $V_{SD}$ of the first reference voltage source 11 is the low level voltage $V_{SS}$, and the output voltage $V_{DS}$ of the second reference voltage source 12 is the high level voltage $V_{DD}$. The branch where the first capacitor C1, the second capacitor C2, the N-type driving transistor Tn, the first reference voltage source 11, the second reference voltage source 12 and the first light emitting device D1 are located is connected.

Figure 11:
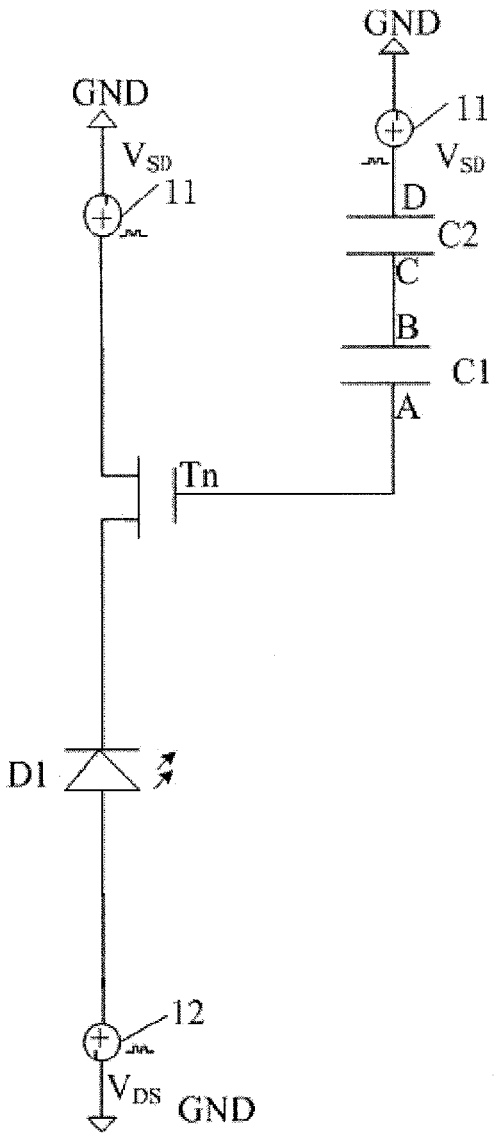
FIG. 11 is a structural schematic diagram of a pixel circuit with a function of driving a light emitting device to emit light corresponding to the first driving sub-circuit according to an embodiment of the present disclosure.

At this time, the pixel circuit shown in FIG. 6 is equivalent to the circuit structure shown in FIG. 11.

As shown in FIG. 11, the voltage at the first terminal (terminal A) of the first capacitor C1 is $V_A=V_g=V_{Data}+V_{th1}-V_{IN1}$. The first capacitor C1 discharges, and the gate voltage of the N-type driving transistor Tn is $V_g=V_{Data}+V_{th1}-V_{IN1}$. The source of the N-type driving transistor Tn is connected to $V_{SS}$, i.e. the source voltage $V_s=V_{SS}$. Therefore, the voltage difference between the gate and the source of the N-type driving transistor Tn is $V_{gs}=V_g-V_s-V_{SS}=V_{Data}+V_{th1}-V_{IN1}-V_{SS}$.

Because the N-type driving transistor Tn operates at the saturation state, according to the current characteristic in the saturation state, the drain current of the N-type driving transistor Tn satisfies $$i_{dn}=\frac{K}{2}(V_{gs}-V_{th1})^2,$$

where $i_{dn}$ is the drain current of the N-type driving transistor Tn, and K is a structural parameter which is relatively stable in the same structure.

$$i_{dn}=\frac{K}{2}(V_{Data}-V_{IN1}-V_{SS})^2$$

can be obtained by bringing $V_{gs}=V_{Data}+V_{th1}-V_{IN1}-V_{SS}$ into $$i_{dn}=\frac{K}{2}(V_{gs}-V_{th1})^2.$$

The first light emitting device D1 emits light for displaying under the driving of the drain current $i_{dn}$.

It can be seen that the drain current $i_{dn}$ flowing through the N-type driving transistor Tn is only related to the voltage signal provided by the data signal source 13, and irrelevant with the threshold voltage $V_{th1}$. That is, the pixel circuit has the function of compensating for the threshold voltage $V_{th1}$. The drain current $i_{dn}$ drives the first light emitting device D1 to emit light. The current flowing through D1 would not be different due to the nonuniformality of the threshold voltage $V_{th1}$ of the N-type driving transistor Tn caused by the backboard manufacture process.

In the following, the operating principle of the pixel circuit driving the second light emitting device to emit light will be described by examples.

When the second light emitting device is driven to emit light, the time sequence of respective signal sources in the pixel is the same as the time sequence of driving the first light emitting device to emit light. The difference is that the output voltage $V_{SD}$ of the first reference voltage source 11 is switched to the high level voltage $V_{DD}$ from the low level voltage $V_{SS}$, and the output voltage $V_{DS}$ of the second reference voltage source 12 is switched to the low level voltage $V_{SS}$ from the high level voltage $V_{DD}$.

Stage d: Reset Stage

As shown in FIG. 8, the voltage $V_{Scan1}$ output by the first gate signal source 14 in FIG. 6 is a high level, and the first switch transistor T1 connected to the first gate signal source 14 is turned off. The voltages $V_{Scan2}$ output by the second gate signal source 41 and the third gate signal source 15 are low levels, and the second switch transistor T2, the third switch transistor T3 and the fourth switch transistor T4 connected to the second gate signal source 41 and the third gate signal source 15 respectively are turned on.

The voltage $V_{EM}$ output by the charging control signal source 16 is a low level, and the fifth switch transistor T5 connected to the charging control signal source 16 is turned on.

The first reference voltage source 11 outputs the high level voltage $V_{DD}$, and the second reference voltage source 12 outputs the low level voltage $V_{SS}$. The P-type driving transistor Tp is turned on, and the branch where the P-type driving transistor is located is connected. The N-type driving transistor Tn is turned off and the branch where the N-type driving transistor Tn is located is disconnected.

The third reference voltage source 42 outputs the reference reset voltage $V_{IN1}$.

Figure 12:
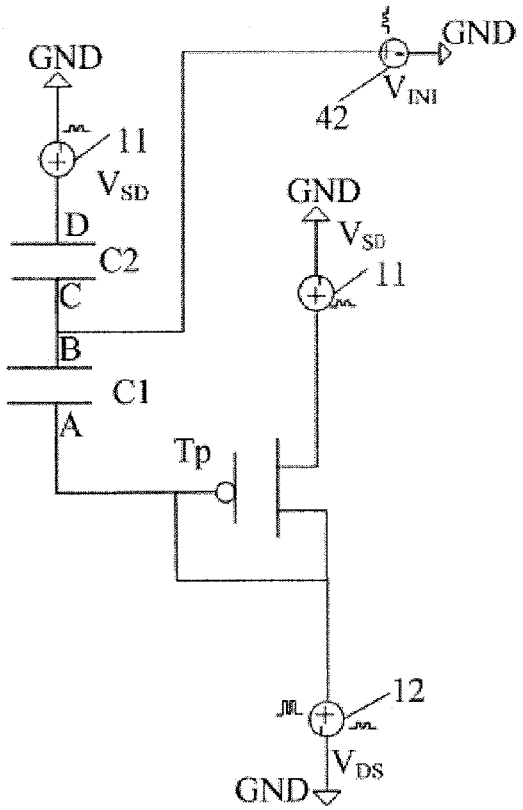
FIG. 12 is a structural schematic diagram of a pixel circuit with reset function corresponding to the second driving sub-circuit according to an embodiment of the present disclosure.

At this time, the pixel circuit shown in FIG. 6 is equivalent to the circuit structure shown in FIG. 12.

The branch where the P-type driving transistor Tn, the first capacitor C1, the third reference voltage source 42, the first reference voltage source 11 and the second reference voltage source 12 are located is connected. The reference reset voltage $V_{IN1}$ output by the third reference voltage source 42 and the high level voltage $V_{DD}$ output by the first reference voltage source are applied to the two terminals of the second capacitor C2, and the voltage at the terminal C of the second capacitor C2 is $V_C=V_{IN1}$. The voltage at the second terminal (terminal B) of the first capacitor C1 i.e. the first terminal (terminal C) of the second capacitor C2 is $V_B=V_C=V_{IN1}$.

Since the fourth switch transistor T4 is turned on, the connection manner of the P-type driving transistor Tp is a diode connection manner. The gate of the P-type driving transistor Tp is discharged to $V_{th2}$, where $V_{th2}$ is the threshold voltage of the P-type driving transistor Tp. At this time, the voltage between the two terminals of the first capacitor C1 is $V_{th2}-V_B=V_{th2}-V_{IN1}$.

Stage e: Writing Stage

As shown in FIG. 8, the voltage $V_{Scan1}$ output by the first gate signal source 14 in FIG. 6 is a low level, and the first switch transistor T1 connected to the first gate signal source 14 is turned on.

The voltages $V_{Scan2}$ output by the second gate signal source 41 and the third gate signal source 15 are high levels, and the second switch transistor T2, the third switch transistor T3 and the fourth switch transistor T4 connected to the second gate signal source 41 and the third gate signal source 15 respectively are turned off.

The voltage $V_{EM}$ output by the charging control signal source 16 is a high level, and the fifth switch transistor T5 connected to the charging control signal source 16 is turned off.

The first reference voltage source 11 outputs the high level voltage $V_{DD}$, and the second reference voltage source 12 outputs the low level voltage $V_{SS}$.

Figure 13:
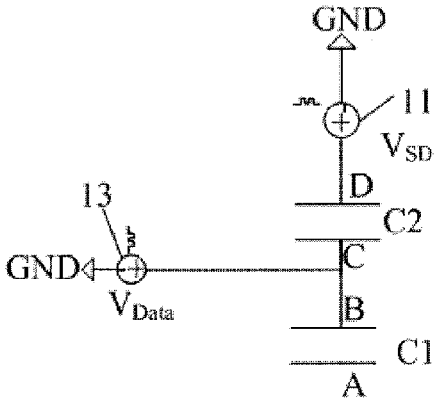
FIG. 13 is a structural schematic diagram of a pixel circuit with charging function corresponding to the second driving sub-circuit according to an embodiment of the present disclosure.

At this time, the pixel circuit shown in FIG. 6 is equivalent to the circuit structure shown in FIG. 13.

The branch where the first capacitor C1, the second capacitor C2, the data signal source 13, the P-type driving transistor Tp and the first reference voltage source 11 are located is connected.

The data signal source 13 outputs the data signal $V_{Data}$ which is applied to the second terminal (terminal B) of the first capacitor C1. According to the principle of charge conservation, the voltage at the first terminal (terminal A) of the first capacitor C1 is $V_A=V_{Data}+V_{th2}-V_{IN1}$. At this time, the data signal is written into the first capacitor C1.

Stage f: Light Emitting Stage

As shown in FIG. 8, the voltage $V_{Scan1}$ output by the first gate signal source 14 in FIG. 6 is a high level, and the first switch transistor T1 connected to the first gate signal source 14 is turned off The voltage $V_{Scan2}$ output by the second gate signal source 41 is a high level, and the second switch transistor T2 connected to the second gate signal source 41 is turned off.

The voltage $V_{Scan3}$ output by the third gate signal source 15 is a high level, and the third switch transistor T3 and the fourth switch transistor T4 connected to the third gate signal source 15 are turned off. The connection manner of the P-type driving transistor Tp is a triode connection manner at this time since the fourth switch transistor T4 is turned off.

The voltage $V_{EM}$ output by the charging control signal source 16 is a low level, and the fifth switch transistor T5 connected to the charging control signal source 16 is turned on.

The output voltage $V_{SD}$ output by the first reference voltage source 11 is the high level voltage $V_{DD}$, and the output voltage $V_{DS}$ output by the second reference voltage source 12 is the low level voltage $V_{SS}$. The branch where the first capacitor C1, the second capacitor C2, the P-type driving transistor Tp, the first reference voltage source 11, the second reference voltage source 12 and the second light emitting device D2 are located is connected.

Figure 14:
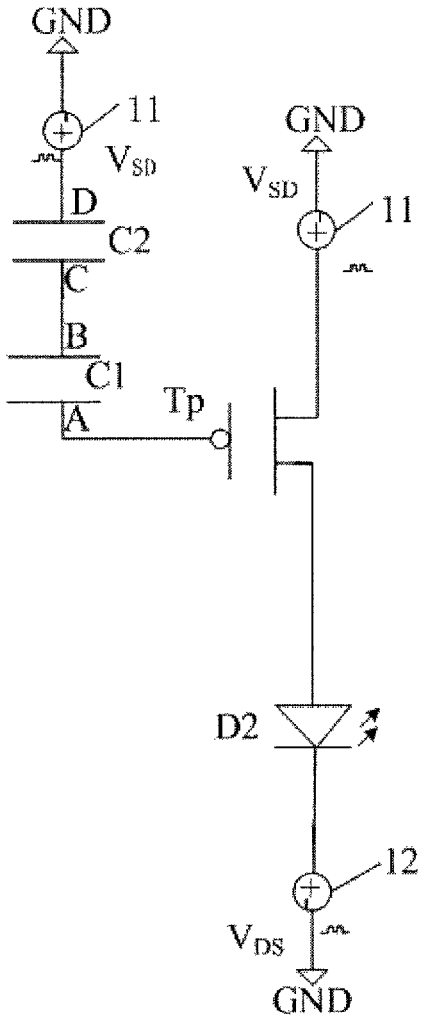
FIG. 14 is a structural schematic diagram of a pixel circuit with a function of driving a light emitting device to emit light corresponding to the second driving sub-circuit according to an embodiment of the present disclosure.

At this time, the pixel circuit shown in FIG. 6 is equivalent to the circuit structure shown in FIG. 14.

As shown in FIG. 14, the voltage at the first terminal (terminal A) of the first capacitor C1 is $V_A=V_{Data}+V_{th2}+V_{DD}-V_{IN1}$. The first capacitor C1 discharges, and the gate voltage of the P-type driving transistor Tp is $V_g=V_{Data}+V_{th2}-V_{IN1}$. The P-type driving transistor Tp is a triode connection manner. The source of the P-type driving transistor Tp is connected to the first reference voltage source 11, the source voltage $V_s=V_{DD}$. The voltage between the gate and the source is $V_{gs}=V_g-V_s=V_{Data}+V_{th2}-V_{IN1}-V_{DD}$.

Because the P-type driving transistor Tp operates at the saturation state, according to the current characteristic in the saturation state, the drain current of the P-type driving transistor Tp satisfies $$i_{dp}=\frac{K}{2}(V_{gs}-V_{th2})^2,$$

where $i_{dp}$ is the drain current of the P-type driving transistor Tp, and K is a structural parameter which is relatively stable in the same structure.

$$i_{dp}=\frac{K}{2}(V_{Data}-V_{IN1}-V_{DD})^2$$

can be obtained by bringing $V_{gs}=V_{Data}+V_{th2}-V_{IN1}-V_{DD}$ into $$i_{dp}=\frac{K}{2}(V_{gs}-V_{th2})^2.$$

The second light emitting device D2 emits light for displaying under the driving of the drain current $i_{dp}$.

It can be seen that the drain current $i_{dp}$ flowing through the P-type driving transistor Tp is only related to the voltage signal provided by the data signal source 13, and irrelevant with the threshold voltage $V_{th2}$. That is, the pixel circuit has the function of compensating for the threshold voltage $V_{th2}$. The drain current $i_{dp}$ drives the second light emitting device D2 to emit light. The current flowing through D2 would not be different due to the nonuniformality of the threshold voltage $V_{th2}$ of the P-type driving transistor Tp caused by the backboard manufacture process.

Figure 15:
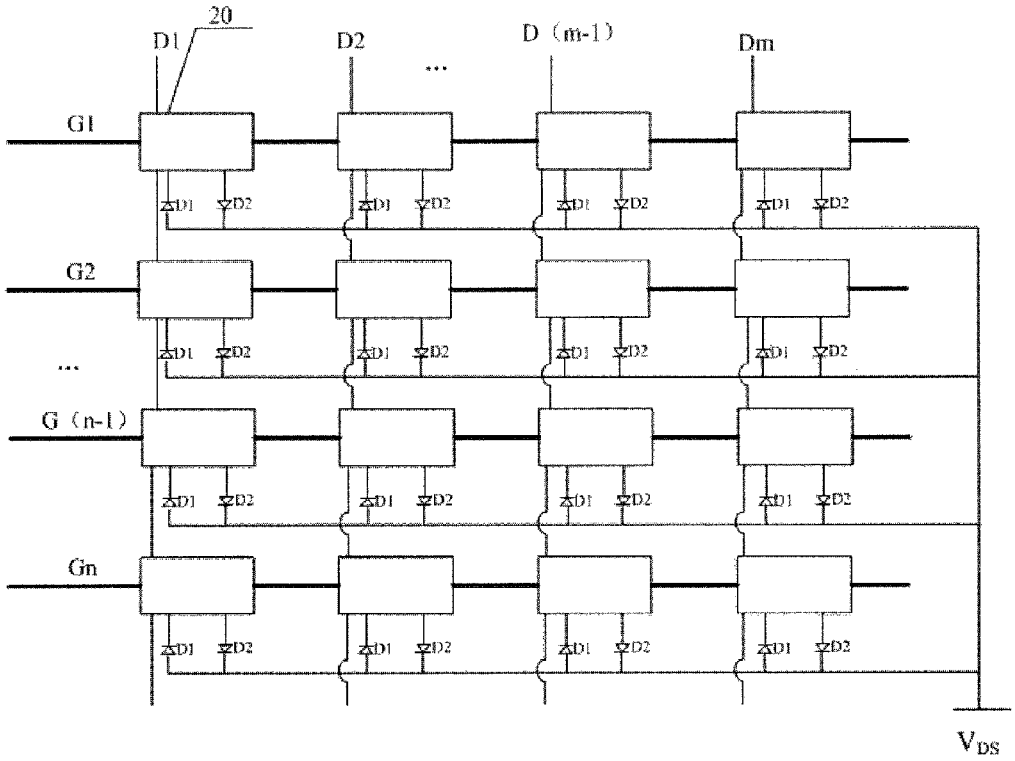
FIG. 15 is a structural schematic diagram of an organic light emitting display panel according to an embodiment of the present disclosure.

An embodiment of the present disclosure also provides a display panel as shown in FIG. 15. The display panel comprises multiple gate lines distributed in the row direction, such as G1, G2, . . . , Gn shown in FIG. 15, multiple data lines distributed in the column direction, such as D1, D2, . . . , Dm shown in FIG. 15, and multiple pixel units surrounded by two adjacent gate lines and data lines.

Each pixel unit comprises one pixel circuit 20 according to an embodiment of the present disclosure and a first light emitting device D1 and a second light emitting device D2 connected to the pixel circuit 20.

The pixel circuits 20 located in the same row are connected to the same gate line, and the pixel circuit 20 located in the same column are connected to the same data line.

Multiple pixel circuits are connected to the same first reference voltage source (not shown in FIG. 15) and the same second reference voltage source. The drain of the first switch transistor in the charging sub-circuit is connected to the data signal source through the data line, and the gate is connected to the first gate signal source through the gate line. The gate signal source and the data signal source charge the first capacitor through the gate line and the data line respectively.

An embodiment of the present disclosure also provides a display apparatus comprising the above display panel. The display apparatus can be an organic electroluminescent display OLED panel, an OLED display, an OLED TV, an electronic paper or the like.

In the present disclosure, the first reference voltage source, the second reference voltage source, the first gate signal source, the data signal source and the charging control signal source are alternate current signals and change with the change of the time sequence.

In conclusion, according to the present disclosure, a first light emitting device and a second light emitting device are arranged in each pixel area, the operating current of the first light emitting device is in the opposite direction to that of the second light emitting device, and the first light emitting device and the second light emitting device are driven to emit light by a N-type driving transistor and a P-type driving transistor respectively. The first light emitting device and the second light emitting device emit light alternately, such that the lifetime of the light emitting devices is at least doubled.

It is obvious that those skilled in the art may make various modifications and variations to the above embodiments without departing the spirit and scope of the present disclosure. Such variations and modifications are intended to be included within the scope of the present disclosure if they fall in the scope of the claims of the present disclosure and equivalents thereof.

What is claimed is:

1. A pixel circuit comprising a charging sub-circuit, a first driving sub-circuit, a second driving sub-circuit, a first capacitor and a second capacitor, wherein a first terminal of the first capacitor is connected to a first terminal of the first driving sub-circuit and a first terminal of the second driving sub-circuit, and a second terminal of the first capacitor is connected to the charging sub-circuit and a first terminal of the second capacitor;

a second terminal of the first driving sub-circuit is connected to a first light emitting device, and a second terminal of the second driving sub-circuit is connected to a second light emitting device, wherein the flow direction of the driving current flowing into the first light emitting device from the first driving sub-circuit is opposite to that of the driving current flowing into the second light emitting device from the second driving sub-circuit; and the charging sub-circuit is used to charge the first capacitor, the second capacitor is used to maintain the voltage at the second terminal of the first capacitor, and when the first capacitor discharges, the first driving sub-circuit drives the first light emitting device to emit light or the second driving sub-circuit drives the second light emitting device to emit light.

2. The pixel circuit of claim 1, wherein the first driving sub-circuit comprises an N-type driving transistor, and the second driving sub-circuit comprises a P-type driving transistor; wherein the gate of the N-type driving transistor is connected to the first terminal of the first capacitor, the source of the N-type driving transistor is connected to a first reference voltage source capable of providing an alternative current (AC) signal, the drain of the N-type driving transistor is connected to the cathode of the first light emitting device, the anode of the first light emitting device is connected to a second reference voltage source capable of providing an AC signal, and a second terminal of the second capacitor is connected to the first reference voltage source; and the gate of the P-type driving transistor is connected to the first terminal of the first capacitor, the source of P-type driving transistor is connected to the first reference voltage source, the drain of the P-type driving transistor is connected to the anode of the second light emitting device, and the cathode of the second light emitting device is connected to the second reference voltage source.

3. The pixel circuit of claim 2, wherein the charging sub-circuit comprises a data signal source, a first gate signal source, and a first switch transistor connected to the data signal source and the first gate signal source;

the drain of the first switch transistor is connected to the data signal source, the source of the first switch transistor is connected to the second terminal of the first capacitor, and the gate of the first switch transistor is connected to the first gate signal source;

the first gate signal source is used to control to turn on the first switch transistor such that the branch where the data signal source and the first capacitor are located is connected, and the data signal source charges the first capacitor.

4. The pixel circuit of claim 3, further comprising a reset sub-circuit comprising a second gate signal source, a second switch transistor and a third reference voltage source to be reset to a reference reset voltage, wherein the source of the second switch transistor is connected to the second terminal of the first capacitor, the drain of the second switch transistor is connected to the third reference voltage source to be reset to the reference reset voltage, and the gate of the second switch transistor is connected to the second gate signal source; and the reset sub-circuit is used to reset the signal stored in the first capacitor to the reference reset voltage before the charging sub-circuit charges the first capacitor.

5. The pixel circuit of claim 4, further comprising a first compensation sub-circuit connected to the first driving sub-circuit and a second compensation sub-circuit connected to the second driving sub-circuit;

the first compensation sub-circuit comprising a third switch transistor;

the second compensation sub-circuit comprising a fourth switch transistor;

wherein the source of the third switch transistor is connected to the gate of the N-type driving transistor, the drain of the third switch transistor is connected to the drain of the N-type driving transistor, and the gate of the third switch transistor is connected to the third gate signal source; and the source of the fourth switch transistor is connected to the gate of the P-type driving transistor, the drain of the fourth switch transistor is connected to the drain of the P-type driving transistor, and the gate of the fourth switch transistor is connected to the third gate signal source.

6. The pixel circuit of claim 5, further comprising a fifth switch transistor for controlling the connection of the first light emitting device and the second light emitting device to the second reference voltage source, wherein the gate of the fifth switch transistor is connected to a charging control signal source, the source of the fifth switch transistor is connected to the anode of the first light emitting device and the cathode of the second light emitting device, the drain of the fifth switch transistor is connected to the second reference voltage source, and the charging control signal source is used to control the turning on and off of the fifth switch transistor.

7. The pixel circuit of claim 6, wherein the first switch transistor, the second switch transistor, the third switch transistor, the fourth switch transistor and the fifth switch transistor are N-type transistors, or the first switch transistor, the second switch transistor, the third switch transistor, the fourth switch transistor and the fifth switch transistor are P-type transistors;

the second gate signal source and the third gate signal source are the same gate signal source.

8. A display panel comprising multiple pixel units arranged in matrix surrounded by gate lines and data lines, each pixel unit comprising one pixel circuit and light emitting devices connected to the pixel circuit, wherein the pixel circuit is a pixel circuit according to claim 1;

the charging sub-circuits in the pixel circuits located in the same row are connected to the same gate line, the charging sub-circuits in the pixel circuits located in the same column are connected to the same data line; at the stage of displaying one frame of picture, before the first driving sub-circuit and the second driving sub-circuit drive the first light emitting device to emit light and the second light emitting device to emit light respectively in sequence, the charging sub-circuits charge the first capacitor through the data line and the gate line.

9. The display panel of claim 8, wherein the drain of the first switch transistor is connected to the data signal source through the data line, the gate of the first switch transistor is connected to the first gate signal source through the gate line; and the gate signal source and the data signal source charge the first capacitor through the gate line and the data line respectively.

10. The display panel of claim 9, wherein the first driving sub-circuit comprises an N-type driving transistor, and the second driving sub-circuit comprises a P-type driving transistor;

the gate of the N-type driving transistor is connected to the first terminal of the first capacitor, the source of the N-type driving transistor is connected to a first reference voltage source capable of providing an alternative current AC signal, the drain of the N-type driving transistor is connected to the cathode of the first light emitting device, the anode of the first light emitting device is connected to a second reference voltage source capable of providing an AC signal, and a second terminal of the second capacitor is connected to the first reference voltage source; and the gate of the P-type driving transistor is connected to the first terminal of the first capacitor, the source of P-type driving transistor is connected to the first reference voltage source, the drain of the P-type driving transistor is connected to the anode of the second light emitting device, and the cathode of the second light emitting device is connected to the second reference voltage source.

11. The display panel of claim 10, wherein the charging sub-circuit comprises a data signal source, a first gate signal source, and a first switch transistor connected to the data signal source and the first gate signal source;

the drain of the first switch transistor is connected to the data signal source, the source of the first switch transistor is connected to the second terminal of the first capacitor, and the gate of the first switch transistor is connected to the first gate signal source;

the first gate signal source is used to control to turn on the first switch transistor such that the branch where the data signal source and the first capacitor are located is connected, and the data signal source charges the first capacitor.

12. The display panel of claim 11, further comprising a reset sub-circuit comprising a second gate signal source, a second switch transistor and a third reference voltage source to be reset to a reference reset voltage, wherein the source of the second switch transistor is connected to the second terminal of the first capacitor, the drain of the second switch transistor is connected to the third reference voltage source to be reset to the reference reset voltage, and the gate of the second switch transistor is connected to the second gate signal source; and the reset sub-circuit is used to reset the signal stored in the first capacitor to the reference reset voltage before the charging sub-circuit charges the first capacitor.

13. The display panel of claim 12, further comprising a first compensation sub-circuit connected to the first driving sub-circuit and a second compensation sub-circuit connected to the second driving sub-circuit;

the first compensation sub-circuit comprising a third switch transistor;

the second compensation sub-circuit comprising a fourth switch transistor;

wherein the source of the third switch transistor is connected to the gate of the N-type driving transistor, the drain of the third switch transistor is connected to the drain of the N-type driving transistor, and the gate of the third switch transistor is connected to the third gate signal source; and the source of the fourth switch transistor is connected to the gate of the P-type driving transistor, the drain of the fourth switch transistor is connected to the drain of the P-type driving transistor, and the gate of the fourth switch transistor is connected to the third gate signal source.

14. The display panel of claim 13, further comprising a fifth switch transistor for controlling the connection of the first light emitting device and the second light emitting device to the second reference voltage source, wherein the gate of the fifth switch transistor is connected to a charging control signal source, the source of the fifth switch transistor is connected to the anode of the first light emitting device and the cathode of the second light emitting device, the drain of the fifth switch transistor is connected to the second reference voltage source, and the charging control signal source is used to control the turning on and off of the fifth switch transistor.

15. The display panel of claim 14, wherein the first switch transistor, the second switch transistor, the third switch transistor, the fourth switch transistor and the fifth switch transistor are N-type transistors, or the first switch transistor, the second switch transistor, the third switch transistor, the fourth switch transistor and the fifth switch transistor are P-type transistors;

the second gate signal source and the third gate signal source are the same gate signal source.

16. A display apparatus comprising a display panel according to claim 8.

17. The display apparatus of claim 16, wherein the drain of the first switch transistor is connected to the data signal source through the data line, the gate of the first switch transistor is connected to the first gate signal source through the gate line; and the gate signal source and the data signal source charge the first capacitor through the gate line and the data line respectively.

* * * * *